US010429023B2

(12) United States Patent
Lee

(10) Patent No.: US 10,429,023 B2
(45) Date of Patent: Oct. 1, 2019

(54) ILLUMINATION DEVICE FOR VEHICLE

(71) Applicant: HYUNDAI MOBIS CO., LTD., Seoul (KR)

(72) Inventor: Seung Chan Lee, Yongin-si (KR)

(73) Assignee: Hyundai Mobis Co., Ltd., Seoul (KR)

( * ) Notice: Subject to any disclaimer, the term of this patent is extended or adjusted under 35 U.S.C. 154(b) by 0 days.

(21) Appl. No.: 16/039,117

(22) Filed: Jul. 18, 2018

(65) Prior Publication Data

US 2019/0024866 A1 Jan. 24, 2019

(30) Foreign Application Priority Data

Jul. 24, 2017 (KR) ..... 10-2017-0093268

(51) Int. Cl.

| | |
|---|---|
| ***F21S 41/32*** | (2018.01) |
| ***F21S 41/365*** | (2018.01) |
| ***F21S 41/25*** | (2018.01) |
| ***F21S 41/33*** | (2018.01) |
| ***F21S 41/43*** | (2018.01) |
| ***F21S 41/689*** | (2018.01) |

(Continued)

(52) U.S. Cl.

CPC ..... *F21S 41/365* (2018.01); *F21S 41/147* (2018.01); *F21S 41/148* (2018.01); *F21S 41/25* (2018.01); *F21S 41/321* (2018.01); *F21S 41/338* (2018.01); *F21S 41/43* (2018.01); *F21S 41/689* (2018.01); *F21S 45/47* (2018.01); *F21V 29/70* (2015.01); *F21W 2102/00* (2018.01); *F21Y 2115/10* (2016.08)

(58) Field of Classification Search

CPC ..... F21S 41/365; F21S 41/321; F21S 41/147; F21S 41/25; F21S 45/47; F21S 41/689; F21S 41/43; F21S 41/338; F21S 41/148; F21V 29/70; F21Y 2115/10; F21W 2102/00

See application file for complete search history.

(56) References Cited

U.S. PATENT DOCUMENTS

2010/0246204 A1* 9/2010 Inaba ..... F21S 41/19 362/539
2011/0211361 A1* 9/2011 Kawamura ..... F21V 29/70 362/516

(Continued)

FOREIGN PATENT DOCUMENTS

KR 10-2011-0084786 A 7/2011
KR 20110084786 * 6/2016 ..... F21S 41/00

*Primary Examiner* — Donald L Raleigh
(74) *Attorney, Agent, or Firm* — Knobbe Martens Olson & Bear LLP

(57) ABSTRACT

An illumination device for a vehicle may include: a light source part; a heat dissipation part mounted on the light source part, and configured to dissipate heat generated from the light source part; a reflector covering the top of the light source part, and configured to reflect the light irradiated from the light source part; a first additional reflector protruding forward from an upper end of the reflector, and configured to reflect the light irradiated from the light source part; a second additional reflector mounted on the heat dissipation part, and configured to reflect the light reflected by the first additional reflector; a shield part configured to pass or block the light reflected by the second additional reflector; and a lens part through which the light reflected by the reflector and the second additional reflector passes.

9 Claims, 5 Drawing Sheets

(51) Int. Cl.

| | |
|---|---|
| ***F21S 45/47*** | (2018.01) |
| ***F21S 41/148*** | (2018.01) |
| ***F21V 29/70*** | (2015.01) |
| ***F21S 41/147*** | (2018.01) |
| *F21Y 115/10* | (2016.01) |
| *F21W 102/00* | (2018.01) |

(56) References Cited

U.S. PATENT DOCUMENTS

| | | | | |
|---|---|---|---|---|
| 2013/0003401 | A1* | 1/2013 | Sekiguchi | F21S 41/338<br>362/517 |
| 2013/0107564 | A1* | 5/2013 | Yatsuda | F21S 45/48<br>362/543 |
| 2013/0188378 | A1* | 7/2013 | Yamamoto | F21V 13/04<br>362/512 |
| 2014/0293635 | A1* | 10/2014 | Tajima | F21S 41/147<br>362/518 |
| 2014/0313757 | A1* | 10/2014 | Ota | F21V 29/74<br>362/516 |
| 2015/0338047 | A1* | 11/2015 | Honda | F21V 13/04<br>362/517 |
| 2016/0265734 | A1* | 9/2016 | Kanayama | F21S 41/143 |
| 2016/0363283 | A1* | 12/2016 | Yamamoto | F21S 41/13 |
| 2018/0066823 | A1* | 3/2018 | Chou | F21S 41/295 |
| 2018/0186279 | A1* | 7/2018 | Chen | F21S 41/255 |
| 2018/0328560 | A1* | 11/2018 | Suzuki | F21S 41/33 |
| 2018/0363874 | A1* | 12/2018 | Kawai | F21S 41/275 |

* cited by examiner

ILLUMINATION DEVICE FOR VEHICLE

CROSS-REFERENCES TO RELATED APPLICATIONS

The present application claims priority to Korean application number 10-2017-0093268, filed on Jul. 24, 2017, which is incorporated by reference in its entirety.

BACKGROUND OF THE INVENTION

The present invention relates to an illumination device for a vehicle, and more particularly, to an illumination device for a vehicle, which can improve optical efficiency.

In general, an illumination device for a vehicle includes a headlamp installed at the front of the vehicle and a rear lamp installed at the rear of the vehicle.

The headlamp serves to illuminate the area head of the vehicle during night driving, and includes a fog light for helping another vehicle or pedestrian to easily recognize the vehicle in the snow, rain or fog and a turn indicator for indicating the traveling direction of the vehicle.

The rear lamp includes a brake light which is lit up when a driver steps on the brake, a rear light which is lit up when vehicle is reversed, and a turn indicator for indicating the traveling direction of the vehicle.

Recently, various light sources such as a light emitting diode (LED) have been applied to a vehicle lamp. The vehicle lamp includes a light source configured to irradiate light and a reflector installed on the rear surface of the light source and configured to reflect light irradiated from the light source forward.

In the conventional vehicle lamp, the light irradiated from the light source reaches the lens through a narrow area. Therefore, the optical efficiency of the vehicle lamp is reduced. Thus, there is a demand for a device capable of solving the problem.

The related art of the present invention is disclosed in Korean Patent Publication No. 2011-0084786 published on Jul. 26, 2011 and entitled "Headlamp for vehicle".

SUMMARY OF THE INVENTION

Embodiments of the present invention are directed to an illumination device for a vehicle, which can improve optical efficiency.

In one embodiment, an illumination device for a vehicle may include: a light source part; a heat dissipation part mounted on the light source part, and configured to dissipate heat generated from the light source part; a reflector covering the top of the light source part, and configured to reflect the light irradiated from the light source part; a first additional reflector protruding forward from an upper end of the reflector, and configured to reflect the light irradiated from the light source part; a second additional reflector mounted on the heat dissipation part, and configured to reflect the light reflected by the first additional reflector; a shield part configured to pass or block the light reflected by the second additional reflector; and a lens part through which the light reflected by the reflector and the second additional reflector passes.

The light source part may include: a light source substrate mounted in a case; and an LED unit mounted on the light source substrate, and turned on as power is applied thereto.

The reflector may include: a reflection coupling part mounted in the case; a reflection extension part extended from the reflection coupling part so as to be disposed above the light source part; and a reflection support part formed at an end of the reflection extension part, and having the first additional reflector coupled thereto.

The reflection coupling part may be extended laterally from the edge of the reflection extension part, and screw-coupled to the case.

The reflection extension part may have a curved surface to induce light irradiated upward from the light source part toward the lens part disposed at the front thereof.

The reflection support part may include: an upper support part protruding upward from the end of the reflection extension part; and a side support part protruding laterally from the end of the reflection extension part.

The first additional reflector may protrude from the end of the reflector toward the lens part, and the light irradiated from the light source part may directly reach the lens part outside the region of the first additional reflector.

The first additional reflector may have a curved surface to reflect light toward the second additional reflector disposed on a diagonal line.

A part of the light irradiated from the light source part may be reflected by the reflector and pass through the lens part, and another part of the light irradiated from the light source part may be sequentially reflected by the first and second additional reflectors, and pass through the lens part.

The reflector and the first additional reflector may be formed as one body.

DESCRIPTION OF SPECIFIC EMBODIMENTS

Hereafter, an illumination device for a vehicle in accordance with an embodiment of the invention will be described in detail with reference to the accompanying drawings. It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

Figure 1:
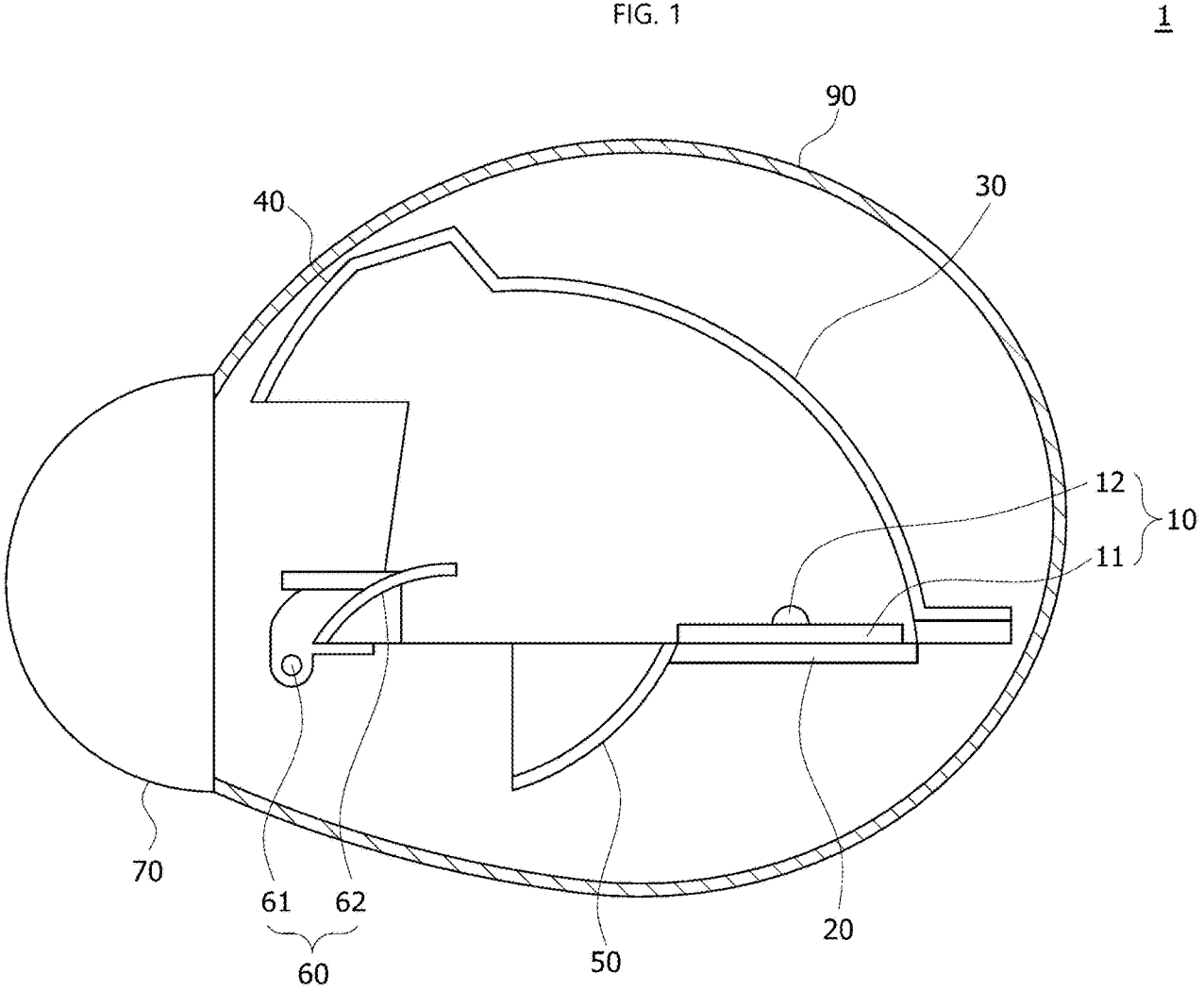
FIG. 1 is a side cross-sectional view schematically illustrating an illumination device for a vehicle in accordance with an embodiment of the present invention.
Figure 2:
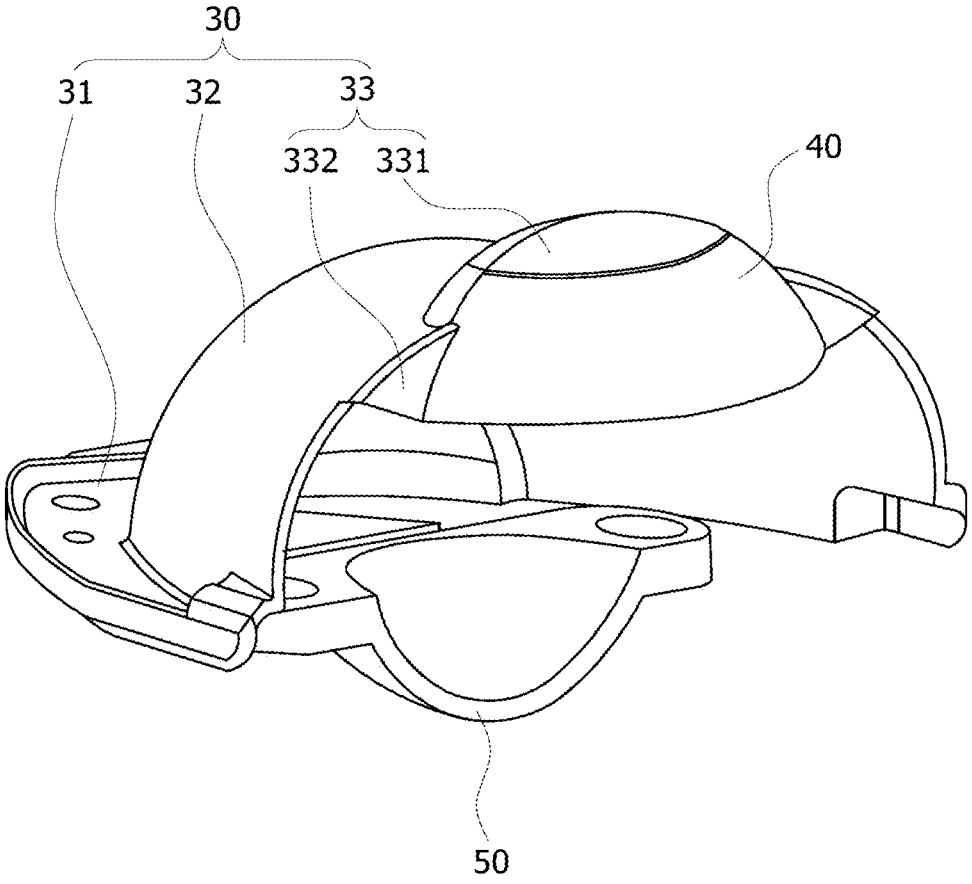
FIG. 2 is a perspective view schematically illustrating the illumination device for a vehicle in accordance with the embodiment of the present invention.
Figure 3:
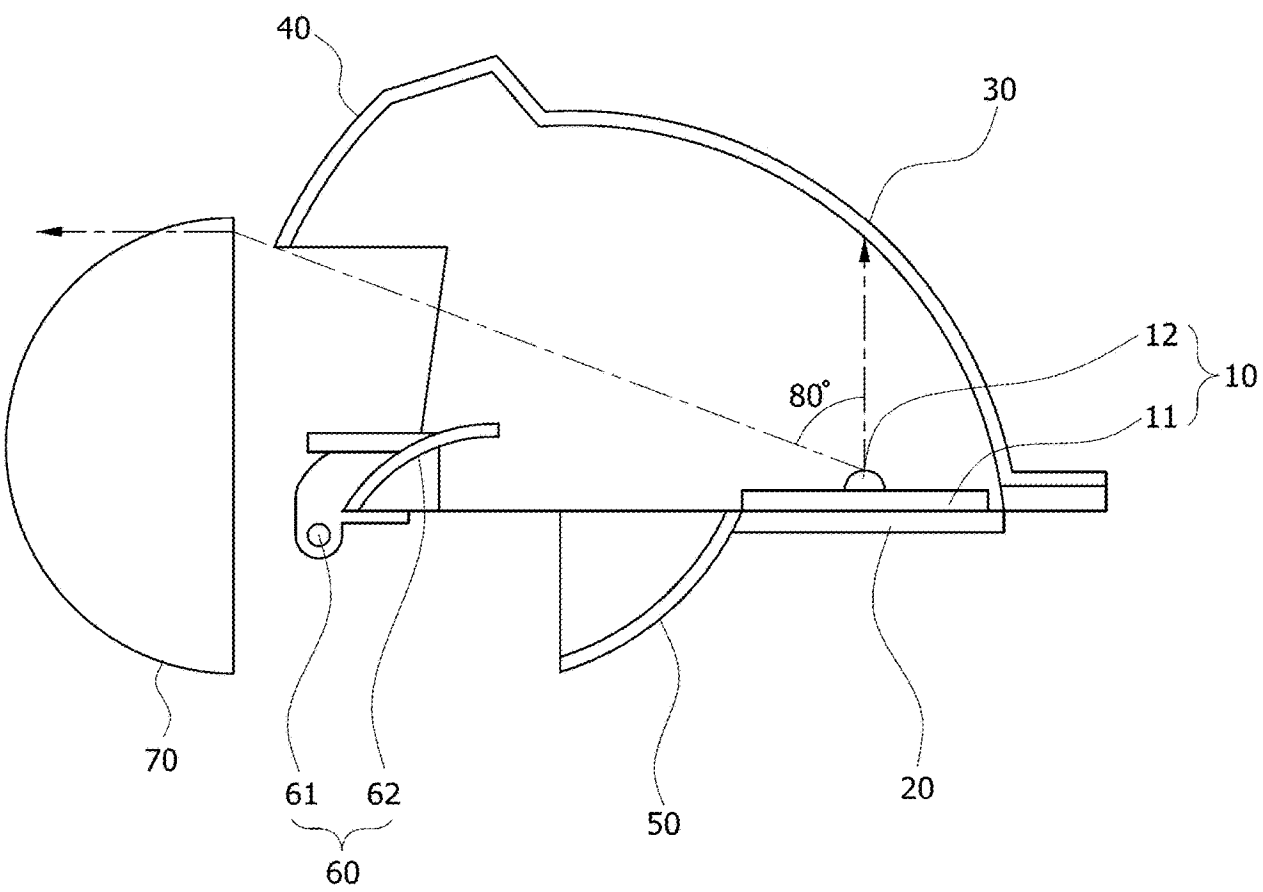
FIG. 3 schematically illustrates an irradiation region of a light source part in the illumination device for a vehicle in accordance with the embodiment of the present invention.

FIG. 1 is a side cross-sectional view schematically illustrating an illumination device for a vehicle in accordance with an embodiment of the present invention, FIG. 2 is a perspective view schematically illustrating the illumination device for a vehicle in accordance with the embodiment of the present invention, and FIG. 3 schematically illustrates an irradiation area of a light source part in the illumination device for a vehicle in accordance with the embodiment of the present invention. Referring to FIGS. 1 to 3, the illumination device 1 for a vehicle in accordance with the embodiment of the present invention may include a light source part 10, a heat dissipation part 20, a reflector 30, a first additional reflector 40, a second additional reflector 50, a shield part 60 and a lens part 70.

The light source part 10 may generate light in response to power applied thereto. The heat dissipation part 20 may be mounted on the light source part 10, and dissipate heat generated by the light source part 10. The reflector 30 may cover the top of the light source part 10, and reflect the light irradiated from the light source part 10. For example, the light generated from the light source part 10 may be reflected by the reflector 30, and moved forward.

The first additional reflector 40 may protrude forward from the top of the reflector 30, and reflect the light irradiated from the light source part 10. The second additional reflector 50 may be mounted on the heat dissipation part 20, and reflect the light reflected by the first additional reflector 40. For example, a part of the light generated by the light source part 10 may be reflected by the first additional reflector 40, reflected by the second additional reflector 50, and then moved forward.

The shield part 60 may pass or block the light reflected by the second additional reflector 50. The light reflected by the reflector 30 and the second additional reflector 50 may pass through the lens part 70. For example, the light reflected by the reflector 30 and the second additional reflector 50 may pass through the lens part 70, and illuminate the area ahead of the vehicle. At this time, the shield part 60 may include a shield driving part 61 and a shield blocking part 62, and the shield blocking part 62 may be rotated by the shield driving part 61, and block or pass the light reflected by the second additional reflector 50. The lens part 70 may include an aspherical lens capable of inducing incident light to travel straight.

The light source part 10 in accordance with the embodiment of the present invention may include a light source substrate 11 and an LED unit 12. The light source substrate 11 may be mounted on a case 90. For example, the case 90 may be installed in the vehicle body, and the light source substrate 11 may be mounted in the case 90. In addition, the light source substrate 11 may be installed in the reflector 30. The LED unit 12 may be mounted on the light source substrate 11, and turned on as power is applied. For example, one LED unit 12 may be arranged on the light source substrate 11.

The reflector 30 in accordance with the embodiment of the present invention may include a reflection coupling part 31, a reflection extension part 32 and a reflection support part 33. The reflection coupling part 31 may be mounted in the case 90. The reflection extension part 32 may be extended from the reflection coupling part 31 so as to be disposed above the light source part 10. The reflection support part 33 may be formed at an end of the reflection extension part 32, and the first additional reflector 40 may be coupled to the reflection support part 33.

For example, the reflection coupling part 31 may be extended laterally from the edge of the reflection extension part 32, and screw-coupled to the case 90. The reflection extension part 32 may have a curved surface to induce light irradiated upward from the light source part 10 toward the lens part 70 disposed at the front thereof. The reflection support part 33 may include an upper support part 331 protruding upward from the end of the reflection extension part 32 and a side support part 332 protruding laterally from the end of the reflection extension part 32.

The first additional reflector 40 may protrude from an end of the reflector 30, i.e. the reflection support part 33 toward the lens part 70. The reflector 30 and the first additional reflector 40 may be formed as one body. In addition, the first additional reflector 40 may be connected or screw-coupled to the end of the reflector 30.

The first additional reflector 40 may have a curved surface to reflect light toward the second additional reflector 50 disposed on a diagonal line. The light irradiated from the light source part 10 may directly reach the lens part 70 as well as the reflecting region of the first additional reflector 40.

That is, a part of the light irradiated from the light source part 10 may be reflected by the reflector 30 and then pass through the lens part 70, and another part of the light irradiated from the light source part 10 may be sequentially reflected by the first and second additional reflectors 40 and 50 and then pass through the lens part 70.

Furthermore, another part of the light irradiated from the light source part 10 may directly pass through the lens part 70. At this time, the protrusion length of the first additional reflector 40 and the position of the lens part 70 may be adjusted in order to prevent light from being lost between the first additional reflector 40 and the lens part 70. Thus, the optical efficiency can be improved. Therefore, a beam angle of up to 80 degrees corresponding to the actual irradiation area of the LED unit 120 may be used as the light source.

Figure 4:
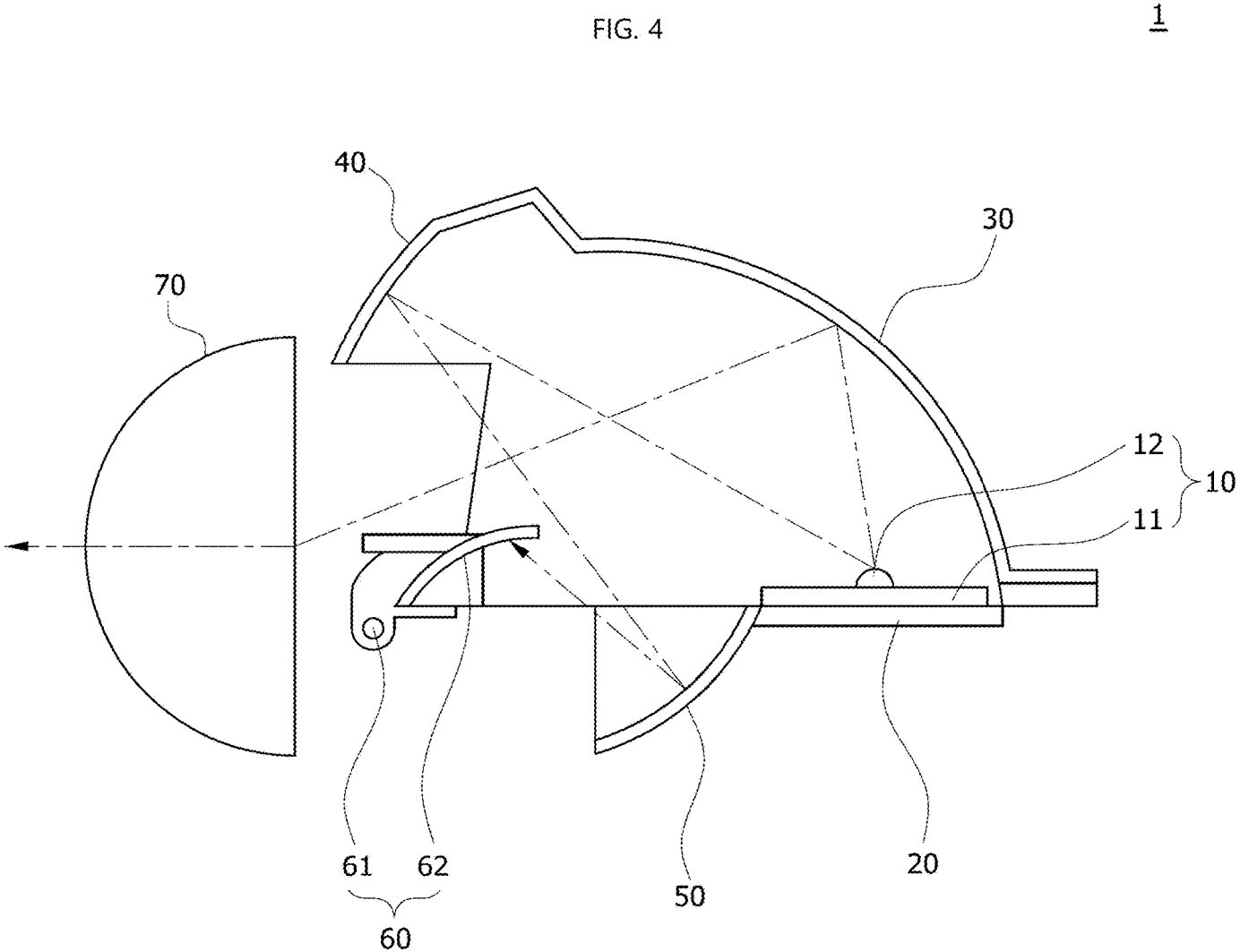
FIG. 4 schematically illustrates a low beam state in the illumination device for a vehicle in accordance with the embodiment of the present invention.

FIG. 4 schematically illustrates a low beam state of the illumination device for a vehicle in accordance with the embodiment of the present invention. Referring to FIG. 4, when the illumination device is in the low beam state, the shield part 60 may be disposed on a traveling path of light reflected by the second additional reflector 50, and block travel of the light reflected through the second additional reflector 50. Therefore, the light generated by the light source part 10 may be passed through the lens part 70 by the reflector 30, thereby forming a low beam.

Figure 5:
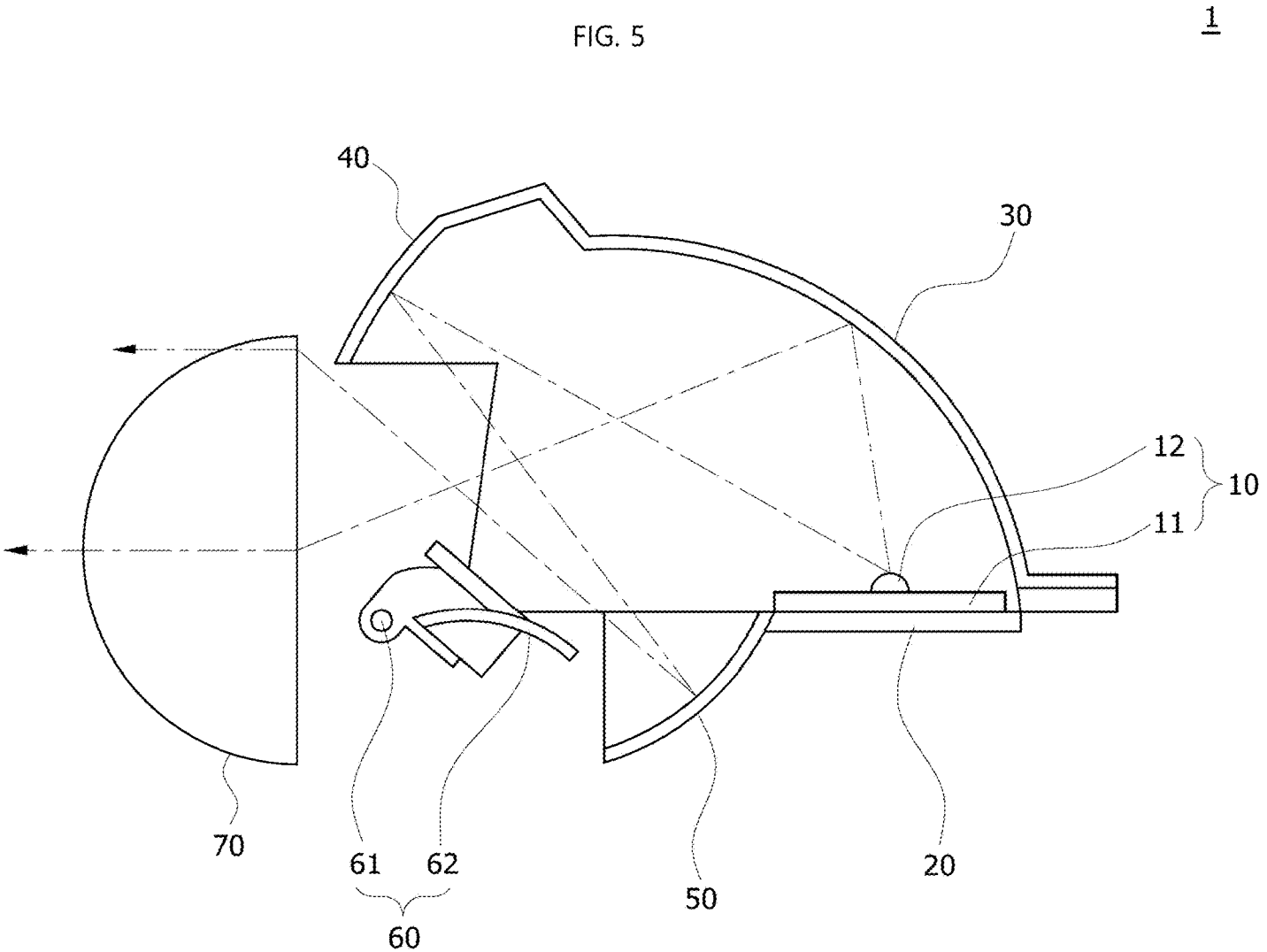
FIG. 5 schematically illustrates a high beam state in the illumination device for a vehicle in accordance with the embodiment of the present invention.

FIG. 5 schematically illustrates a high beam state of the illumination device for a vehicle in accordance with the embodiment of the present invention. Referring to FIG. 5, when the illumination device is in the high beam state, the shield part 60 may be disposed out of the traveling path of the light reflected by the second additional reflector 50, and allow the travel of the light reflected through the second additional reflector 50. Therefore, the light generated by the light source part 10 may reach the top of the lens part 70 through the first and second additional reflectors 40 and 50, thereby forming a high beam.

In the illumination device 1 for a vehicle in accordance with the embodiment of the present invention, the first additional reflector 40 protruding forward from the reflector 30 can reflect light toward the second additional reflector 50, and the light reflected by the second additional reflector 50 can reach the lens part 70, thereby improving the optical efficiency.

In the illumination device 1 for a vehicle in accordance with the embodiment of the present invention, the light irradiated from the light source part 10 may directly reach the lens part 70 outside the first additional reflector 40, which makes it possible to suppress a light loss.

The illumination device 1 for a vehicle in accordance with the embodiment of the present invention can improve the light intensity further than the existing illumination devices, because a light loss is suppressed. Furthermore, since the light intensity is maintained to a longer distance, the illumination device 1 can improve the night vision.

Although preferred embodiments of the invention have been disclosed for illustrative purposes, those skilled in the art will appreciate that various modifications, additions and substitutions are possible, without departing from the scope and spirit of the invention as defined in the accompanying claims.

What is claimed is:

1. An illumination device for a vehicle, comprising:

a light source part;

a heat dissipation part mounted on the light source part, and configured to dissipate heat generated from the light source part;

a reflector covering the top of the light source part, and configured to reflect the light irradiated from the light source part;

a first additional reflector protruding forward from an upper end of the reflector, and configured to reflect the light irradiated from the light source part;

a second additional reflector mounted on the heat dissipation part, and configured to reflect the light reflected by the first additional reflector;

a shield part configured to pass or block the light reflected by the second additional reflector; and a lens part through which the light reflected by the reflector and the second additional reflector passes, wherein the reflector comprises:

a reflection coupling part mounted in a case, a reflection extension part extended from the reflection coupling part so as to be disposed above the light source part, and a reflection support part formed at an end of the reflection extension part, and having the first additional reflector coupled thereto.

2. The illumination device of claim 1, wherein the light source part comprises:

a light source substrate mounted in the case; and an LED unit mounted on the light source substrate, and turned on as power is applied thereto.

3. The illumination device of claim 1, wherein the reflection coupling part is extended laterally from the edge of the reflection extension part, and screw-coupled to the case.

4. The illumination device of claim 1, wherein the reflection extension part has a curved surface to induce light irradiated upward from the light source part toward the lens part disposed at the front thereof.

5. The illumination device of claim 1, wherein the reflection support part comprises:

an upper support part protruding upward from the end of the reflection extension part; and a side support part protruding laterally from the end of the reflection extension part.

6. The illumination device of claim 1, wherein the first additional reflector protrudes from the end of the reflector toward the lens part, and the light irradiated from the light source part directly reaches the lens part outside the region of the first additional reflector.

7. The illumination device of claim 1, wherein the first additional reflector has a curved surface to reflect light toward the second additional reflector disposed on a diagonal line.

8. The illumination device of claim 1, wherein a part of the light irradiated from the light source part is reflected by the reflector and passes through the lens part, and another part of the light irradiated from the light source part is sequentially reflected by the first and second additional reflectors, and passes through the lens part.

9. The illumination device of claim 1, wherein the reflector and the first additional reflector are formed as one body.

* * * * *